United States Patent [19]

Witte, Jr. et al.

[11] Patent Number: 4,483,776

[45] Date of Patent: Nov. 20, 1984

[54] LITHIUM COMPLEX SOAP THICKENED GREASE CONTAINING CALCIUM ACETATE

[75] Inventors: Arnold C. Witte, Jr., Port Neches; Aubrey L. Stone, Beaumont; Patrick F. Woloszyn, Galveston, all of Tex.

[73] Assignee: Texaco Inc., White Plains, N.Y.

[21] Appl. No.: 505,507

[22] Filed: Jun. 17, 1983

[51] Int. Cl.[3] ..... C10M 5/14; C10M 5/16

[52] U.S. Cl. ..... 252/40; 252/17

[58] Field of Search ..... 252/17, 40

[56] References Cited

U.S. PATENT DOCUMENTS

| | | | |
|---|---|---|---|
| 2,719,122 | 9/1955 | Morway | 252/40 |
| 2,850,459 | 9/1958 | Mikeska et al. | 252/40 |
| 2,950,248 | 8/1960 | Armstrong et al. | 252/40 |
| 3,909,426 | 9/1975 | Horodysky et al. | 252/17 |

*Primary Examiner*—Jacqueline V. Howard

*Attorney, Agent, or Firm*—Robert A. Kulason; Jack H. Park; Richard A. Morgan

[57] ABSTRACT

Lithium complex grease compositions which contain a certain weight ratio of calcium acetate are provided which demonstrate a constant viscosity over a wide temperature range.

10 Claims, 3 Drawing Figures

VISCOSITY-TEMPERATURE RELATIONSHIP
COMPOSITION VARIATIONS
EQUIVALENT VISCOSITY (CP)
40,000
20,000
10,000
8,000
6,000
4,000
2,000
1,000
100
200
300
400
500
600
TEMPERATURE (°F)
2
3
4

VISCOSITY-TEMPERATURE RELATIONSHIP
PROCESSING VARIATIONS
EQUIVALENT VISCOSITY (CP)
40,000
20,000
10,000
8,000
6,000
4,000
2,000
1,000
100
200
300
400
500
TEMPERATURE (°F)
2
5
6

LITHIUM COMPLEX SOAP THICKENED GREASE CONTAINING CALCIUM ACETATE

FIELD OF THE INVENTION

Lithium complex greases are well known and used in a variety of applications. However, as has been discovered, the viscosity of lithium complex soap thickened greases is dependent on the temperature: the viscosity gradually decreases as the temperature increases. Because the viscosity is highly dependent upon the temperature, the use of lithium complex soap thickened greases has been avoided in many applications, such as in wheel bearing greases.

It is with the instant invention that a lithium complex grease has been provided having a lower viscosity-temperature dependence than what is observed in prior art lithium complex greases. With the lithium complex grease provided, having contained therein calcium acetate in a certain weight ratio, the viscosity value remains substantially the same over a wide range of temperatures. This low viscosity-temperature dependence in lithium complex greases is a significant improvement over prior art lithium complex greases, which have a very high viscosity-temperature dependence, and it allows the use of the instant greases in many more applications. This would be especially so in applications where a lithium complex grease having a constant viscosity over a wide temperature range is needed, such as in a grease for wheel bearings.

INFORMATION DISCLOSURE STATEMENT

U.S. Pat. No. 3,909,426 discloses a lithium complex grease composition containing a synergistic combination of calcium acetate and dibenzyl disulfide. The calcium acetate in combination with the sulfur-containing material, preferably dibenzyl disulfide, acts together in combination as extreme pressure improvers.

U.S. Pat. No. 2,719,122 discloses a grease comprising, in approximately equimolar proportions, lithium soaps of $C_{12}$ to $C_{22}$ fatty acids and alkaline earth metal salts. In preparing the grease both the monovalent metal soap of the higher fatty acids and a divalent low molecular weight salt, such as calcuim acetate, are added as a dry powder, or if the monovalent metal soap is formed in situ it is completely dehydrated before the dry-powdered divalent salt is added. By this anhydrous method of soap-salt dispersion the exchange of bases between the soaps is prevented.

U.S. Pat. No. 2,908,645 discloses a grease comprised from about 20 to 60 percent of a lithium base grease and from 40 to 80 percent of a complex thickened grease. This complex thickened grease comprises an alkaline earth metal hydroxide or carbonate, such as calcium hydroxide, in combination with one of three mixtures which vary in amount and percentage of low, intermediate, and long chain fatty acids.

SUMMARY OF THE INVENTION

Calcium acetate-containing lithium complex greases are provided in which the calcium acetate and lithium soap are present, respectively, in a 1.2:1 to 1.7:1 weight ratio to provide a lithium complex soap having a constant viscosity over a wide temperature range.

Also, in accordance with the instant invention, this calcium acetate-containing lithium complex grease having an exceedingly constant viscosity over a wide temperature range is prepared by a process comprising the steps of:

(1) slowly adding a sufficient amount of glacial acetic acid to a mixture comprising water, lubricating oil and lime, to react with the lime to form calcium acetate;

(2) heating the calcium acetate-containing oil mixture to a temperature below the boiling temperature of water;

(3) adding a sufficient amount of a mixture comprising 12-hydroxystearic acid and azelaic acid so that the total amount of fat, that is, the glacial acetic acid added in step (1) and the just added 12-hydroxystearic acid and azelaic acid, is present in a 1 to 3 weight ratio with the oil;

(4) dehydrating the mixture;

(5) cooling the mixture to a temperature below the boiling point of water and then adding in excess of the neutralizing amount a concentrated aqueous solution of approximately 8 to 10 weight percent of lithium hydroxide to the mixture containing the 12-hydroxystearic acid and azelaic acid at a controlled rate of below about 0.30 lbs./minute per 100 lbs. of finsihed grease product, with the amount of lithium complex soap formed present in a weight ratio of about 1:1.2 to 1:1.7 with the calcium acetate;

(6) effecting substantially complete saponification between the fatty acids and lithium hydroxide by extending for a sufficient period the time of reaction;

(7) heating the mixture until it is uniformly at a temperature of from about 390° to about 420° F.;

(8) rapidly cooling the mixture and incorporating the remainder of the lubricating oil into the grease composition.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE PREFERRED EMBODIMENTS

Figure 1:
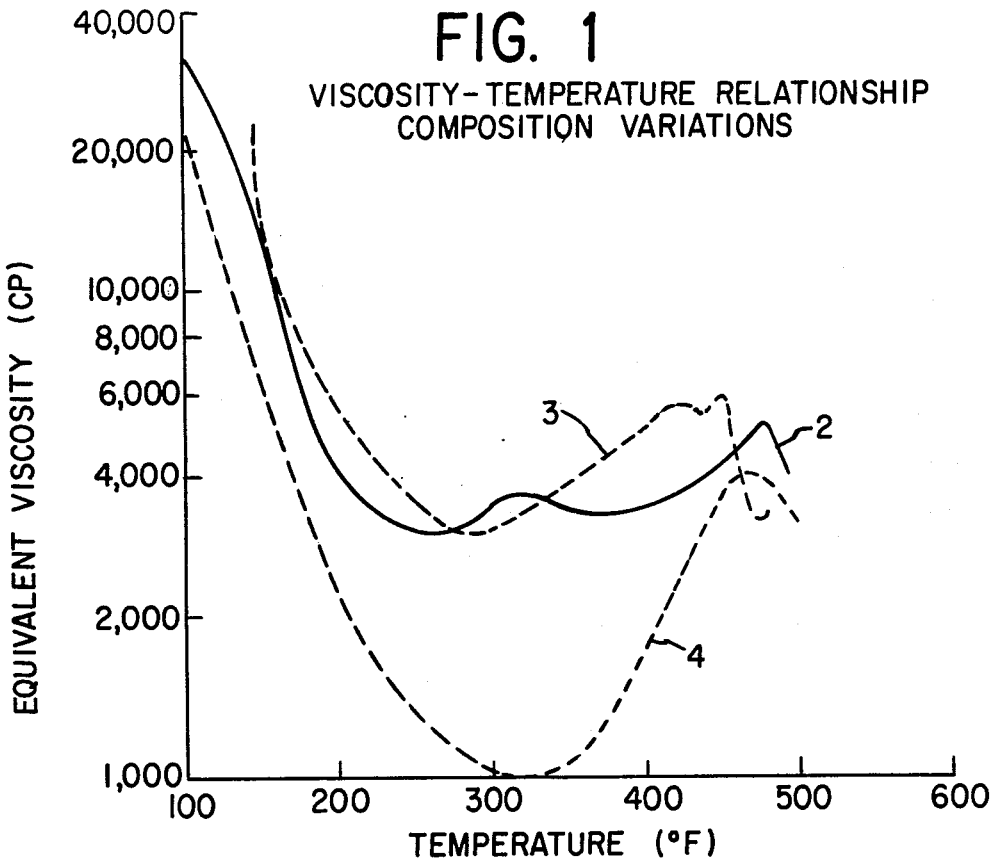
FIG. 1 represents a graph in which there is compared over a wide range of temperatures the viscosities of several grease compositions, including the one of the instant invention.

The calcium acetate-containing lithium complex grease composition of the invention comprises a lubricating oil base and about 15 to 35 weight percent of a mixture of calcium acetate and a lithium complex soap, with the calcium acetate in a 1.2:1 to 1.7:1 weight ratio with the lithium complex soap. Greases of this type in which the calcium acetate is in a 1.2:1 to 1.7:1 weight ratio with lithium complex soap, demonstrate a relatively constant viscosity over a wide temperature range, that is, a viscosity of 3500 cp (plus or minus 500 cp) over temperatures ranging from about 200° to 450° F.

In the instant grease, the calcium acetate and lithium complex soap are present in a 1.2:1 to 1.7:1 weight ratio, and are preferably present in a 1.25:1 to 1.5:1 weight ratio.

The acid component of the lithium soap comprises a mixture of $C_{12}$ to $C_{24}$ hydroxy fatty acids and $C_4$ to $C_{12}$ aliphatic dicarboxylic acids.

The hydroxy fatty acid employed in the lithium complex soap will have from about 12 to 24, and more usually about 16 to 20 carbon atoms, and will preferably be hydroxystearic acid, e.g., 9-hydroxy-, 10-hydroxy-, or 12-hydroxy-stearic acid, and most preferably 12-hydroxystearic acid. Other hydroxy acids which can be used include: ricinoleic acid, 12-hydroxytetradecanoic acid, 10-hydroxytetradecanoic acid, 12-hydroxyhexadecanoic acid, 8-hydroxyhexadecenoic acid, 12-hydroxyicosanic acid and 16-hydroxyicosanic acid.

The dicarboxylic acid employed in the lithium complex soap of this invention will have from 4 to 12 carbon atoms, preferably 6 to 10 carbon atoms. Such acids include succinic, glutaric, adipic, suberic, pimelic, azelaic, dodecanedioic, and sebacic acid. Azelaic acid is preferred.

There is no set proportion of hydroxy fatty acids to dicarboxylic acids in the acid mixture used to prepare the lithium soap. The hydroxy fatty acid may be present in from 99 weight percent to 1 weight percent of the acid mixture and the dicarboxylic acid may be present in from 1 weight percent to 99 weight percent of the acid mixture; the exact weight percent comprising the acid mixture of hydroxy fatty acid and dicarboxylic acid will depend upon the specific physical properties which are being sought in the prepared lithium complex soap. The preferred weight ratio of 12-hydroxystearic to azelaic acid in the mixture is about 1.8:1 to 2.1:1.

The total lithium soap content of the grease of the present invention will be in the range of from about 5 to 20 weight percent and preferably from 8 to 15 weight percent.

The calcium acetate which is employed in the instant grease is formed in situ during the manufacturing process and is not added preformed. Preferably, the lime and the glacial acetic acid are reacted to form the calcium acetate before the lithium complex soap is prepared.

The calcium acetate is present in the instant grease in from about 6 to 20 weight percent and preferably from 12 to 18 weight percent.

The lubricating oils forming the major constituent of these greases may be any oil of lubricating characteristics which is suitable for use in lubricating greases generally. Mineral lubricating oil base stocks used in preparing a grease can be any conventionally refined base stocks derived from paraffinic, naphthenic and mixed base crudes. Such oils include particularly the conventional mineral lubricating oils having Saybolt Universal viscosities in the range from about 35 seconds to 300 seconds at 210° F., which may be either naphthenic or paraffinic in type, or blends of different oils. When a blend of lubricating oils is employed to make the grease composition, the oils may be blended separately prior to use in the grease making process or they may be blended as used in the grease making process. The preferred mineral oils are those having Saybolt Universal viscosities in the range from about 60 seconds to about 80 seconds at 210° F., which may be blends of lighter and heavier oils in the lubricating oil viscosity range.

Synthetic lubricating oils which may be preferred for obtaining greases having special properties required for certain types of lubricating service include oils prepared by cracking and polymerizing products of the Fisher Tropsch process and the like, as well as other synthetic oleaginous compounds such as diesters, polyesters, polyethers, etc. having viscosities within the lubricating oil viscosity range. Examples of suitable diesters include the aliphatic dicarboxylic acid diesters, such as di-2-ethylhexyl sebacate, di(secondary amyl) sebacate, di-2-ethylhexyl azelate, di-iso-octyladipate, etc. Other synthetic oils that can be used include synthetic hydrocarbons such as alkyl benzenes, e.g., alkylate bottoms from the alkylation of benzene with tetrapropylene, or the copolymers of ethylene and propylene; silicone oils, e.g., ethyl phenyl polysiloxanes, methyl polysiloxanes, etc.; polyglycol oils, e.g., those obtained by condensing butyl alcohol with propylene oxide; carbonate esters, e.g., the product of reacting $C_8$ oxo alcohol with ethyl carbonate to form a half ester followed by reaction of the latter with tetraethylene glycol, etc.

The invention also concerns a process for preparing this calcium acetate-containing lithium complex grease in which the calcium acetate to lithium complex soap is in a weight ratio of 1.2:1 to 1.7:1. The key sequence of steps included in this invention are:

(1) slowly adding a sufficient amount of glacial acetic acid to a mixture comprising water, lubricating oil and lime, to completely react with the lime to form calcium acetate;
(2) heating the calcium acetate-containing oil mixture to a temperature below the boiling temperature water;
(3) adding a sufficient amount of a mixture comprising 12-hydroxystearic acid and azelaic acid so that the total amount of fat, that is, the glacial acetic acid added in step 1 and the just added 12 -hydroxystearic acid and azelaic acid, is present in a 1 to 3 weight ratio with the oil;
(4) dehydrating the mixture;
(5) cooling the mixture to a temperature below the boiling temperature of water and the adding in excess of the neutralizing amount a concentrated aqueous solution of approximately 8 to 10 weight percent of lithium hydroxide to the the mixture containing 12-hydroxystearic acid and azelaic acid at a controlled rate of below about 0.30 lbs./minute per 100 lbs. of finished grease product, with the amount of formed lithium complex present in a weight ratio of about 1:1.2 to 1:1.7 with the calcium acetate;
(6) substantially complete saponification between the fatty acids and lithium hydroxide by extending for a sufficient period the time of reaction;
(7) heating the mixture until it is uniformly at a temperature of from 390° to about 420° F.;
(8) rapidly cooling the mixture and incorporating the remainder of the lubricating oil into the grease composition.

According to the present invention, a mixture comprising water, lubricating oil and lime is prepared and placed in a reaction vessel. The water is present in a sufficient amount to dissolve the lime; and the lubricating oil is present in a sufficient amount so that when the total amount of fat, including 12-hydroxystearic acid and azelaic acid and glacial acetic acid, is added the weight ratio of lubricating oil to fat should be about 3 to 1. Stirring of the mixture is begun and continues throughout the batch making process. The glacial acetic acid is then added to the reaction vessel at a slow rate, that is, about one quarter pound per minute. After a sufficient amount of glacial acid has been added and the lime is completely reacted therewith, the batch is heated to a temperature below the boiling point of water (i.e., 150°-170° F.). Once the batch reaches this temperature, the 12-hydroxystearic acid and azelaic acid are added. The ratio of 12-hydroxystearic acid to azelaic acid is about 2 to 1. To dissolve the added fats, the batch is heated to 250° F. and held at that temperature for 1 hour. After the fat has been thoroughly dissolved, and the mixture is dehydrated, the oil and calcium acetate-acid mixture is then brought to temperature below the boiling point of water, preferably to about 200°-210° F. and the lithium hydroxide is added. The lithium hydroxide is added at a controlled rate as a concentrated aqueous solution of approximately 8 to 10 weight percent and preferably 9.4 weight percent lithium. This rate is usually below about 0.30 lbs./minute per 100 lbs. of finished grease product and preferably from about 0.05 to about 0.25 lbs./minute per 100 lbs. of finished grease product with the preferred rate being about 0.15 lbs./minute per 100 lbs. of finished grease product. The amount of lithium hydroxide solution added is usually slightly in excess of that required to neutralize the acid. While the alkali is being added, the mixture may be slowly circulated at a rate of one lb./minute for every 2 to 10 lbs. of mixture in the kettle, giving one kettle volume turn over every 2 to 10 minutes and preferably at a rate of 1 lb./minute for every 2 to 5 lbs. of mixture in the kettle which gives one kettle volume turn over every 2 to 5 minutes. Most preferably the circulation rate is 1 lb. per minute for approximately every 3 lbs. of mixture in the kettle giving one kettle volume turn over approximately every 3 minutes. After the alkali addition is complete, the mixture is maintained at a temperature below the boiling point of water, that is, 210° F., and preferably 180° F. to 210° F., until saponification is substantially complete which may take from 15 to about 45 minutes, and more likely about 30 minutes. The temperature is further raised after substantially complete saponification has taken place, until the mixture is uniformly at a temperature of from about 390° F. to 420° F. and preferably from 410° F. to 420° F. The minimum heating time at this temperature is usually 15 to 30 minutes and frequently an hour or more. The mixture is then rapidly cooled to below about 375° F. by quenching it with additional oil, that is, approximately 5 to 25 percent and preferably 5 to 10 percent of the total amount of lubricating oil employed in the finished grease composition. The mixture may be further cooled by an external cooling means such as an insulating jacket or heat exchanger. The remainder of the base oil and any desired additives may be incorporated into the mixture as it cools. Upon completion of the oil addition, the mixture may be milled. Although milling is not necessary for the preparation of a satisfactory grease, according to the process of this invention, it improves the appearance of the grease, eliminating any lumpiness and therefore greases made according to the process of this invention are usually milled.

It is preferred that the calcium acetate be formed in situ and that it be formed before the lithium soaps are prepared. It is also preferred that the highest temperature reached during the heating process of step 7 be less than 420° F.

The nature of this invention and the manner in which it is practiced will be better understood when reference is made to the following examples which include preferred embodiments.

EXAMPLE I

Six compositions comprising calcium acetate-containing lithium complex soap greases were prepared. The amount of calcium, that is, the weight ratio of calcium acetate to lithium complex soap varies from 0.42:1 in Composition 1 to 1.88:1 in Composition 4.

As a representative example, the manufacturing process employed to prepare Composition 2 is discussed in greater detail below:

(1) to a kettle add 13.6 lbs of lime, 24.5 grams of lubricating oil, and water;
(2) meter in glacial acetic acid at a rate of ¼ lb./min.;
(3) heat batch to 150° to 170° F.;
(4) add 7.3 lbs of 12-hydroxystearic acid and 3.6 lbs of azelaic acid;
(5) stir and heat batch to 250° F. and hold at 250° to 260° F. for one hour;
(6) cool batch to 200° to 210° F. and begin adding lithium hydroxide solution at 0.01 lb/min per lb. fat;
(7) hold batch at 200°-210° F. for 30 minutes;
(8) heat batch to 410° to 420° F. and hold for 30 minutes;
(9) quench batch with approximately 8 wt % of the total oil and begin cooling batch to 200° F.;
(10) add remainder oil at 0.3 lb/min. when batch temperature reaches 325° F. and continue to cool until a batch temperature of 200° F. is reached;
(11) stir and circulate batch for 30 minutes at 200° F.; and
(12) mill.

An analogous procedure was followed in preparing the other compositions, with the only difference being the final weight ratio of lithium complex soap to calcium acetate and, of course, the amount of the starting materials, such as acetic, azelaic and 12-hydroxystearic acids, employed. In addition, in Composition 5 the highest temperature to which the grease was heated was 450° F. (step 8 above), which is 30° F. higher than the preferred maximum heating temperature of 420° F., and in Composition 6, the lithium complex soap was formed first and the lime and glacial acetic acid were added thereafter to form the calcium acetate, as opposed to forming the calcium acetate first (steps 1 and 2 above) as is the preferred method in the instant invention.

The exact nature of the composition of these six greases is detailed below in Table 1.

TABLE 1

| | 1[a] | 2 | 3 | 4 | 5 | 6 |
|---|---|---|---|---|---|---|
| Calcium Acetate: Lithium Complex soap (wt ratio) | 0.42:1 | 1.25:1 | 1.66:1 | 1.88:1 | 1.25:1 | 1.25:1 |
| Thickener, wt % | | | | | | |
| Lithium complex soap total | 12.0 | 10.9 | 11.3 | 8.0 | 11.9 | 11.9 |
| (Lithium | (8.0) | (7.3) | (7.5) | 5.3 | (7.9) | (7.9) |

TABLE 1-continued

| | 1[a] | 2 | 3 | 4 | 5 | 6 |
|---|---|---|---|---|---|---|
| 12-OH Stearate) (Lithium Azelate) | (4.0) | (3.6) | (3.8) | 2.7 | (4.0) | (4.0) |
| Calcium Acetate | 5.0 | 13.6 | 18.8 | 15.0 | 14.9 | 14.9 |

[a]Grease composition No. 1 did not form a grease.

EXAMPLE II

The equivalent viscosity (hereinafter called viscosity) was determined using a Trident Probe. In this testing procedure a beaker containing the grease is placed on a heater which is capable of heating the sample under controlled heating conditions, that is, raising the temperature a measured amount per minute. The Trident Probe is an instrument which is placed in the sample and by rotating in the same measures the torque required to keep the probe in motion. By means of a mathematical formula, the torque values obtained are converted to viscosity values.

The viscosity of grease Compositions 2, 3 and 4 were tested over a temperature range of 100° F. to 500° F. The results are detailed in FIG. 1.

As can be seen, Composition 4 containing calcium acetate and lithium complex soap in a weight ratio of 1.88 to 1 failed to demonstrate a constant viscosity over the temperature range: the viscosity steadily decreased until a temperature of 325° F. was reached at which point the viscosity steadily increased until it leveled off at 450° F. and then started to decrease again. Composition 3 to some extent and Composition 2 to a greater extent, demonstrated a constant viscosity over a wide temperature range. Composition 1 maintained a fairly high and constant viscosity over a temperature range of almost 250° F.: the viscosity of grease Composition 1 was 3500 cp at 205° F. and remained constant (plus or minus 500 cp) until 450° F.

Figure 2:
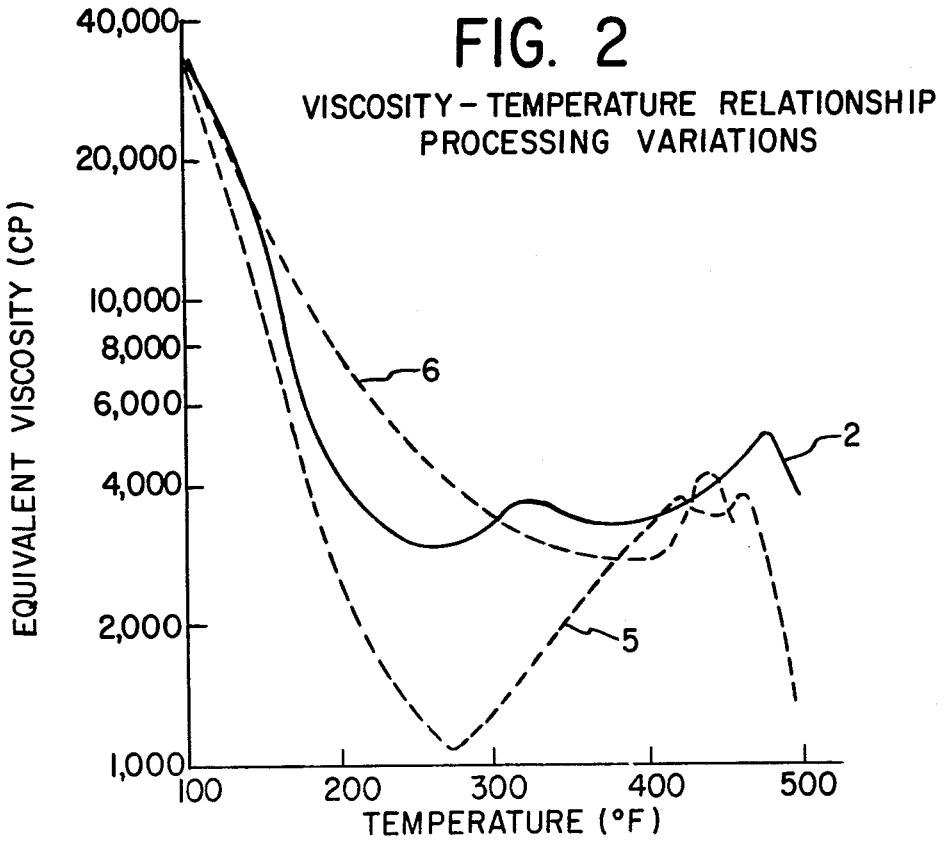
FIG. 2 represents a graph in which there is compared over a wide range of temperatures the viscosities of several grease compositions prepared under different process conditions, including the one of the instant invention.

The viscosity of grease Compositions 2, 5, and 6 were compared over a wide temperature range employing a Trident Probe. The results of this test are detailed in FIG. 2.

As can be seen, Composition 5 in which the top heating temperature is 450° F., as opposed to the preferred 420° F., and Composition 6 in which the calcium acetate is formed after the formation the lithium complex soap, as opposed to before, do not demonstrate the same fairly high and relatively constant viscosity characteristics of Composition 2. In Composition 5 the viscosity steadily decreases until a temperature of 275° F. is reached and then it steadily increases and at 450° F. it levels off and steadily decreases again. In Composition 6 the viscosity steadily decreases and levels off at 375° F. at which point it increases and then decreases in rapid fashion.

EXAMPLE III

Three greases were prepared and their viscosity determined. Grease No. 1 is a lithium complex soap thickened grease with 11.7 weight percent total lithium complex soap; there is no calcium acetate present. Grease No. 2 is a calcium complex soap thickened grease with 24.0 weight percent total calcium complex soap; there is no lithium soap or lithium salt present. Grease No. 3 has the same composition as that of Grease Composition No. 2 prepared in Example I. Data relating to the composition of these greases and to the processes for their preparation are highlighted in Table II below:

TABLE II

| Total Thickener, wt % | 1[a] | 2[b] | 3[c] |
|---|---|---|---|
| Lithium Complex Soap | 11.7 | — | 12.0 |
| Calcium Complex Soap | — | 24 | — |
| Calcium acetate | — | — | 13.6 |
| Calcium Acetate: Lithium Complex Soap (wt ratio) | — | — | 1.25:1 |

[a]prepared in accordance with the process outlined in Example I, with the differences being that the steps relating to the in situ formation of calcium acetate have been eliminated.

[b]prepared in accordance with the following procedure:

(1) to a kettle was charged base oil, fatty acid (12-hydroxystearic), lime, and water (the mole ratio of the calcium acetate to the calcium-12-hydroxystearate is 14:1);

(2) the batch was heated to 170–180° F. and then circulation begun as is the injection of glacial acetic acid;

(3) after the addition of the glacial acetic acid, circulation shear was begun and the batch was heated to a top temperature of 325–335° F.;

(4) the bath was corrected for free alkali and cooled to 200° F.;

(5) the rest of base oil was added as was any desired additives; and (6) the product was filtered.

[c]prepared in accordance with the process outlined in Example I for the preparation of Composition 2.

Figure 3:
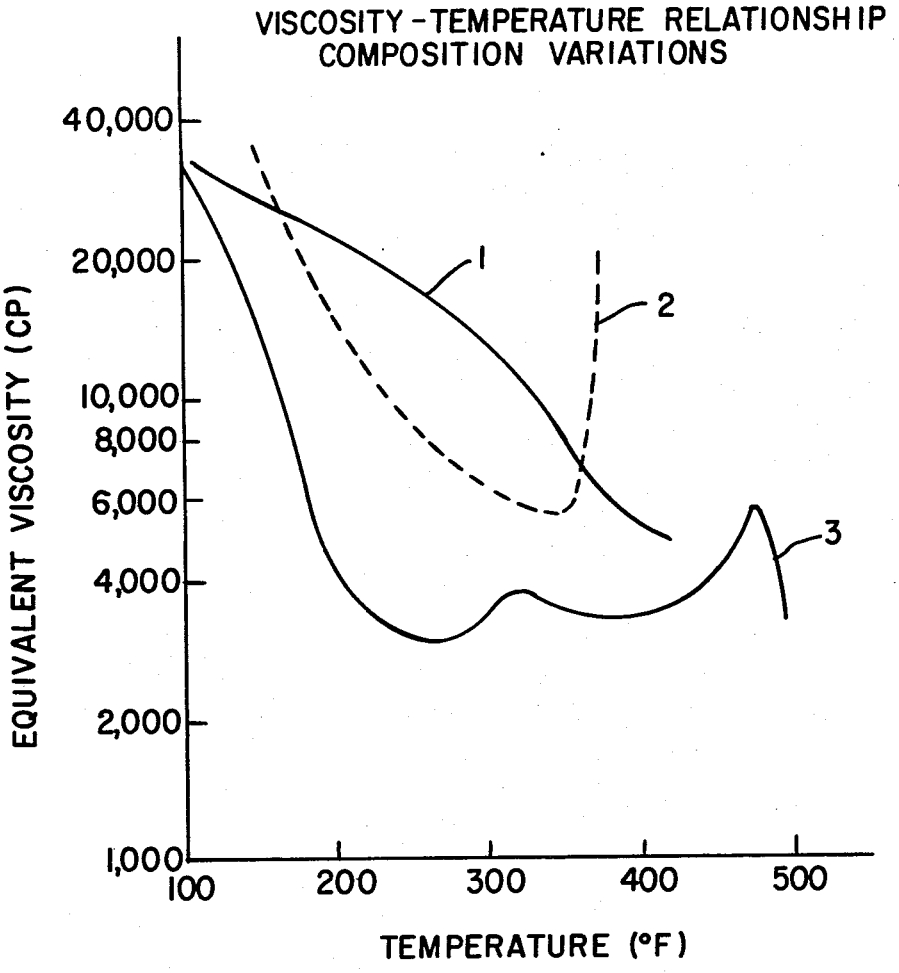
FIG. 3 represents a graph in which there is compared over a wide range of temperatures the viscosities of several different types of greases, including the one of the instant invention.

The viscosity of these three greases were compared employing a Trident Probe. The results are detailed in FIG. 3.

As can be seen, Grease No. 3, the grease of the instant invention in which there is present calcium acetate and lithium complex soap in a 1.25:1 weight ratio, revealed a much lower temperature-viscosity dependence over most of the tested temperature range than did either of the other two greases. Grease No. 1 comprising only the lithium complex soap demonstrated that its viscosity is very dependent on temperature: As the temperature increased, the viscosity gradually decreased. Grease No. 2 comprising only the calcium complex soap demonstrated that its viscosity was also very temperature dependent: The viscosity first declined as the temperature increased and then at about 350° F. the viscosity dramatically increased in an almost instantaneous fashion.

As is demonstrated, it is unexpected and surprising that a calcium acetate-containing lithium complex grease in which the calcium acetate and lithium complex soap are in a 1.2:1 to 1.7:1 ratio possess a low temperature-viscosity dependence; that is, the viscosity remains fairly uniform over a wide temperature range. The viscosity of the instant grease composition was 3500 cp (plus or minus 500 cp) over temperatures ranging from 205° F. to 450° F. (a range of almost 250° F.)

What is claimed is:

1. A grease composition characterized by having a relatively constant viscosity over a temperature range of from about 200° F. to 500° F. comprised of a major amount of a lubricating oil and from about 15 to 35 weight percent based on the said grease composition of a mixture of calcium acetate and lithium complex soaps, said mixture consisting of calcium acetate and lithium complex soap in 1.2:1 to 1.7:1 weight ratio respectively.

2. A grease composition according to claim 1 wherein the calcium acetate and lithium complex soap are in a 1.25 to 1.5:1 weight ratio.

3. A grease composition according to claim 1 wherein said lithium complex soap comprises a mixture of lithium 12-hydroxystearate and lithium azelate.

4. A grease composition according to claim 3 wherein the weight ratio of 12-hydroxystearic to azelaic acid is about 1.8:1 to 2.1:1.

5. A grease composition according to claim 1 wherein the grease comprises from about 5 to about 20% lithium complex soap, and from about 6 to about 20% calcium acetate.

6. A grease according to claim 5 wherein the grease comprises from about 8 to about 15% lithium complex soap, and from about 12 to 18% calcium acetate.

7. A process for preparing a grease composition characterized by having a relatively constant viscosity over a temperature range of from about 200° F. to 500° F. comprising the steps of:

(a) slowly adding a sufficient amount of glacial acetic acid to a mixture comprising water, lubricating oil and lime, to completely react with the lime to form calcium acetate;

(b) heating the calcium acetate-oil containing mixture to a temperature below the boiling temperature of water;

(c) adding a sufficient amount of a mixture comprising 12-hydroxystearic acid and azelaic acid so that the total amount of fat, that is, the glacial acetic acid added in (a) and the just added 12-hydroxystearic acid and azelaic acid, is present in a 1:3 weight ratio with the oil;

(d) dehydrating the mixture;

(e) cooling the mixture to a temperature below the boiling point of water and then slowly adding in excess of the neutralizing amount of a concentrated aqueous solution of approximately 8 to 10 weight percent of lithium hydroxide to the mixture containing the 12-hydroxystearic acid and azelaic acid at a controlled rate of below about 0.30 lbs./minute, per 100 lbs. of finished grease composition with the amount of formed lithium complex soap present in a weight ratio of about 1:1.2 to 1:1.7 with the calcium acetate;

(f) effecting substantially complete saponification between the fatty acids and lithium hydroxide by extending for a sufficient period the time of reaction;

(g) heating the mixture until it is uniformly at a temperature of from about 390° F. to about 420° F.;

(h) rapidly cooling the mixture and incorporating the remainder of the lubricating oil into the grease composition.

8. A process according to claim 7 in which desired additives are incorporated into the grease mixture while the remainder of the lubricating oil is being incorporated into the mixture.

9. A process according to claim 7 in which the formed grease composition is milled.

10. A process according to claim 7 wherein in step (g) the mixture is heated until it is uniformly at a temperature of from about 410° F. to about 420° F.

* * * * *